US007885814B2

(12) United States Patent
Ikegami

(10) Patent No.: US 7,885,814 B2
(45) Date of Patent: Feb. 8, 2011

(54) TEXT INFORMATION DISPLAY APPARATUS EQUIPPED WITH SPEECH SYNTHESIS FUNCTION, SPEECH SYNTHESIS METHOD OF SAME

(75) Inventor: Takashi Ikegami, Kanagawa (JP)

(73) Assignee: Kyocera Corporation, Kyoto (JP)

( * ) Notice: Subject to any disclaimer, the term of this patent is extended or adjusted under 35 U.S.C. 154(b) by 1308 days.

(21) Appl. No.: 11/393,330

(22) Filed: Mar. 30, 2006

(65) Prior Publication Data

US 2006/0224386 A1 Oct. 5, 2006

(30) Foreign Application Priority Data

Mar. 30, 2005 (JP) ..... 2005-100133

(51) Int. Cl.
*G10L 13/08* (2006.01)

(52) U.S. Cl. ..... 704/260

(58) Field of Classification Search ..... 704/260
See application file for complete search history.

(56) References Cited

U.S. PATENT DOCUMENTS

| | | | | |
|---|---|---|---|---|
| 5,899,975 | A * | 5/1999 | Nielsen | 704/270.1 |
| 6,810,378 | B2 * | 10/2004 | Kochanski et al. | 704/258 |
| 2002/0013708 | A1 * | 1/2002 | Walker et al. | 704/260 |
| 2004/0054535 | A1 * | 3/2004 | Mackie et al. | 704/260 |
| 2004/0111271 | A1 * | 6/2004 | Tischer | 704/277 |
| 2005/0071165 | A1 * | 3/2005 | Hofstader et al. | 704/270.1 |
| 2006/0090138 | A1 * | 4/2006 | Wang et al. | 715/760 |

FOREIGN PATENT DOCUMENTS

| | | |
|---|---|---|
| JP | 11-252216 | 9/1999 |
| JP | 2000187493 A | 7/2000 |
| JP | 2001343991 A | 12/2001 |
| JP | 2002312157 A | 10/2002 |
| JP | 2004-185055 | 7/2004 |

OTHER PUBLICATIONS

Japanese language office action dated Jun. 29, 2010 and its English language translation for corresponding Japanese application 2005100133 lists the references above.

* cited by examiner

*Primary Examiner*—Michael N Opsasnick
(74) *Attorney, Agent, or Firm*—DLA Piper LLP (US)

(57) ABSTRACT

A text information display apparatus equipped with a speech synthesis function able to clearly display a linked portion by speech and enabling easy recognition of a change from a link, provided with a controller for referring to the display rules of text to be converted to speech when converting text included in text information being displayed on a display unit to speech, controlling a speech synthesizing processing unit so as to convert the text to speech with a first voice in a case of predetermined display rules (presence of link destination, cursor position display, etc.) and convert the text to speech with a second voice having a speech quality different from that of the first voice in the case of not the predetermined display rules, and controlling the speech synthesizing processing unit so as to convert the text included in a display object to speech with a third voice when the display object linked with the link destination is selected or determined by a key operation unit.

8 Claims, 16 Drawing Sheets

FIG. 2C
FIG. 2A
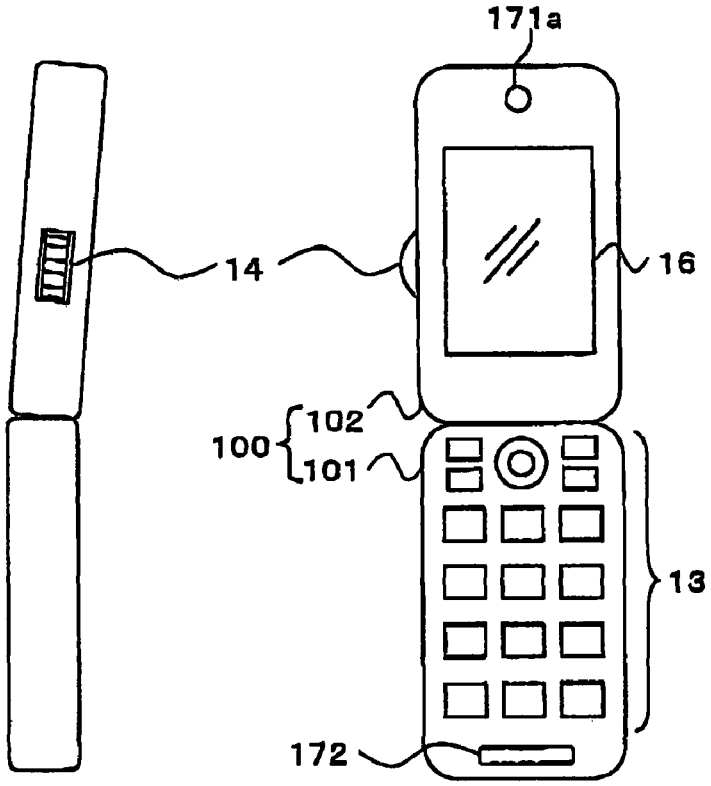
FIG. 2D
FIG. 2B
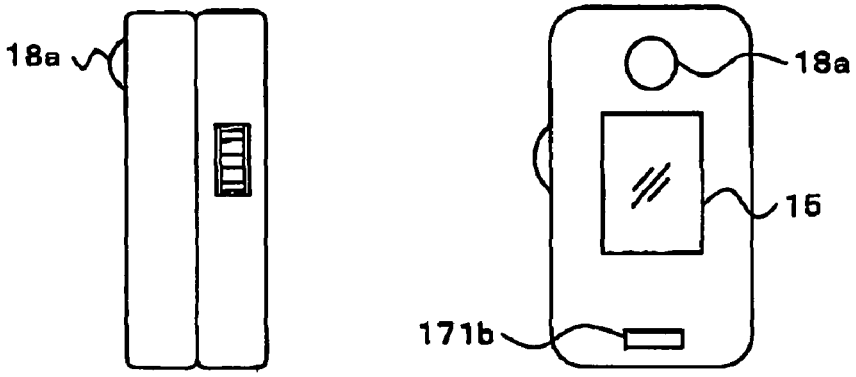

FIG. 4

FRUIT:
APPLES 100YEN TWO
ORANGES 200YEN
MELONS 300YEN
STRAWBERRIES 400YEN

※ "APPLES", "TWO", AND "MELONS" SHOW LINK
※ "APPLES" SELECTED BY CURSOR

FIG. 5

| | |
|---|---|
| NOTIFIED INFORMATION OF "APPLES" | COORDINATE VALUES ( X : 0 , Y : 5 ), |
| | STYLE: LINK |
| | NUMBER OF LETTERS: 6 |
| SETTING OF CURRENT FONT SIZE | FONT SIZE STANDARD |
| CORRECTION VALUE OF STYLE (LINK) | FONT SIZE SMALL: Y-3, FONT SIZE STANDARD: Y-5, FONT SIZE LARGE: Y-8 |

STORAGE MANAGEMENT INFORMATION

| x | y | STYLE | LENGTH | *READ_ptr |
|---|---|---|---|---|
| 0 | 0 | 0x00 | 6 | |
| 100 | 20 | 0x00 | 5 | |
| 200 | 20 | 0x00 | 3 | |
| 30 | 40 | 0x00 | 5 | |
| 130 | 40 | 0x00 | 6 | |
| 60 | 60 | 0x00 | 6 | |
| 160 | 60 | 0x00 | 5 | |
| 0 | 80 | 0x00 | 6 | |
| 100 | 80 | 0x00 | 5 | |
| 0 | 20 | 0x01 | 6 | |
| : | : | : | | |
| : | : | : | | |
| | | 0xFF | | |

STORAGE REGION OF TEXT

BEFORE TEXT SORTING

AFTER TEXT SORTING

【EXAMPLE OF DESCRIPTION】

<addr jtle="addr lin click">hmnl</addr>

DISPLAY REQUEST ITEMS OF BROWSER

| # | Sfr | x | y |
|---|---|---|---|
| 1 | ABC | 0 | 0 |
| 2 | DEF | 30 | 20 |
| 3 | GHI | 60 | 20 |
| 4 | JKL | 0 | 60 |
| 5 | PQR | 60 | 80 |
| 6 | STU | 30 | 120 |
| 7 | VWX | 0 | 140 |
| 8 | MNO | 0 | 80 |

※DISPLAY REQUEST COMES LAST WHEN CURSOR HITS LINK OF TEXT

FIG. 14A

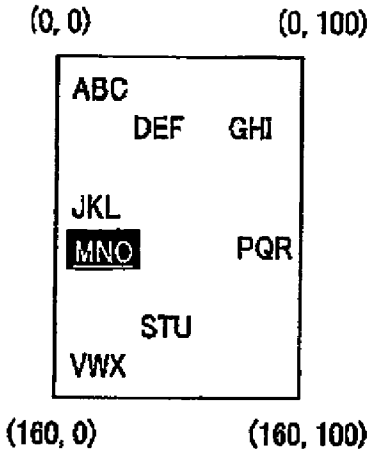

FIG. 14B

DISPLAY REQUEST ITEMS OF BROWSER

| # | Sfr | x | y |
|---|---|---|---|
| 1 | ABC | 0 | 0 |
| 2 | DEF | 30 | 20 |
| 3 | GHI | 60 | 20 |
| 4 | JKL | 0 | 60 |
| 5 | PQR | 60 | 80 |
| 6 | STU | 30 | 120 |
| 7 | VWX | 0 | 140 |
| 8 | MNO | 0 | 80 |

※DISPLAY REQUEST COMES LAST WHEN CURSOR HITS LINK OF TEXT

FIG. 14C

AFTER TEXT-TO-SPEECH SORT

| # | Sfr | x | y |
|---|---|---|---|
| 1 | ABC | 0 | 0 |
| 2 | DEF | 30 | 20 |
| 3 | GHI | 60 | 20 |
| 4 | JKL | 0 | 60 |
| 5 | MNO | 0 | 80 |
| 6 | PQR | 60 | 80 |
| 7 | STU | 30 | 120 |
| 8 | VWX | 0 | 140 |

SORT ALGORITHM: SORT IN UPWARD SEQUENCE BY Y-COORDINATES
NOTE, WHERE VALUES OF Y ARE SAME, X-COORDINATES ARE COMPARED IN UPWARD SEQUENCE
WHERE ALSO VALUES OF X ARE SAME, VALUE ISSUING DISPLAY REQUEST FIRST IS GIVEN HIGHEST PRIORITY

TEXT-TO-SPEECH TEXT: 「ABCDEFGHIJKLMNOPQRSTUVWX」
(SPEECH REVERSE)

TEXT-TO-SPEECH SEQUENCE (WHOLE PAGE)

TEXT-TO-SPEECH SEQUENCE (TIME OF LINE SCROLLING)

TEXT INFORMATION DISPLAY APPARATUS EQUIPPED WITH SPEECH SYNTHESIS FUNCTION, SPEECH SYNTHESIS METHOD OF SAME

BACKGROUND OF THE INVENTION

1. Field of the Invention

The present invention relates to a text information display apparatus equipped with a speech synthesis function having a function of converting items being displayed from text into speech, a speech synthesis method of the same, and a speech synthesis program.

2. Description of the Related Art

In recent years, as mobile terminals, mobile phones speaking aloud the names of functions etc. set by key operations corresponding to key operations have been proposed (see for example Japanese Patent Publication (A) No. 11-252216). Such a mobile phone has a plurality of key operation units, a controller for setting a function corresponding to one or more key operations of the key operation units among a plurality of functions provided in the phone, and a speech synthesizer for outputting by speech the name of the function set linked with the key operations.

Further, as a system employing the speech output function, an e-mail system enabling a sender to select the speech quality to be used for converting text to speech at the receiving side when sending text by e-mail has been proposed (see for example Japanese Patent Publication (A) No. 2004-185055).

In a mobile terminal having the above text-to-speech conversion function, the function is realized by notifying the text to the engine (controller and speech synthesizer) for conversion to speech.

However, the Internet or other installed browsers will notify display information for displaying text to the mobile terminal side, but will not notify the actual text for conversion to speech. The display information is notified with the text divided into small sections, so cannot be notified to the text-to-speech engine as it is. Further, a sequence of notification of the text will not always be from the top of the display, therefore if converting the text to speech in the sequence of notification, a suitable sentence will not be obtained. Further, according to a style of the display, even text on the same row may be notified with deviated coordinate values, therefore will not be able to be treated as text on the same row.

Further, in many content, the user depresses a link in order to change screens. For this reason, many links are arranged in content in actual circumstances. Accordingly, it is necessary to make the user recognize the link by text-to-speech conversion and, at the same time, notify the correct depression of the link to the user by the text-to-speech conversion. Namely, a linked portion cannot be clearly notified by speech, so it is difficult to easily recognize a shift from the link.

Further, it is known to modify the browser side and add a text-to-speech interface to realize text-to-speech conversion, but even in this case, general sites (HTML etc.) cannot be displayed. Only specific sites can actually be handled.

SUMMARY OF THE INVENTION

An object of the present invention is to provide a text information display apparatus equipped with a speech synthesis function not only able to realize smooth text-to-speech conversion, but also able to easily recognize the state of a browser by clearly converting the linked portion to speech or converting a shift from a link to speech even for sentences on a screen displayed by the browser, a speech synthesis method of the same, and a speech synthesis program.

According to a first aspect of the present invention, there is provided a text information display apparatus provided with a storage unit for storing text information including display objects and display rules for defining display styles of the display objects, a display unit for displaying the display object stored in the storage unit, a speech synthesizer for converting text to speech, and a controller for referring to the display rules of text to be converted to speech when converting text included in text information being displayed on the display unit to speech at the speech synthesizer, and controlling the speech synthesizer so as to convert the text to speech with a first voice in a case of a predetermined display rules and to convert the text to speech with a second voice in a case of not a predetermined display rule.

Preferably, the apparatus is further provided with a communication unit for connecting to a network and acquiring the text information.

Preferably, the apparatus is further provided with an operation unit for selecting at least one display object included in the text information displayed on the display unit, and the predetermined display rules include a selection position display rule indicating that an object is a display object selected by the operation unit.

Preferably, the predetermined display rules include a link destination display rule indicating that a link destination is linked with a display object.

Preferably, the apparatus is further provided with an operation unit for determining at least one display object included in the text information displayed on the display unit, and the controller makes the speech synthesizer convert the text included in the display object to speech with a third voice when a display object linked with the link destination is selected or determined by the operation unit.

Preferably, the apparatus is further provided with an operation unit for determining at least one display object included in the text information displayed on the display unit, and the controller controls the speech synthesizer so as to convert the text included in the determined display object to speech after the link destination is accessed by the communication unit when a display object linked with the link destination is determined by the operation unit.

Preferably, the apparatus is further provided with an operation unit for selecting and for determining at least one display object included in the text information displayed on the display unit, the predetermined display rules include a selection position display rule for indicating that an object is a display object selected by the operation unit, and the controller controls the speech synthesizer so as to convert the text included in the display object defined by the selection position display rule to speech when the determined by the operation unit.

According to a second aspect of the present invention, there is provided a text-to-speech method in a text information display device for storing text information including display objects and display rules for defining display styles of the display objects and for displaying the display objects, comprising a speech synthesizing step for converting text included in the display object to speech, a referring step for referring to the display rules of the text converted to speech when converting the text to speech in the speech synthesizing step, a step of converting the text of a display object defined by the predetermined display rules to speech with a first voice, and a step of converting the text of a display object not defined by the predetermined display rules to speech with a second voice.

According to a third aspect of the present invention, there is provided a text-to-speech program able to be run by a computer for realizing text-to-speech conversion in a text information display device storing text information including display objects and display rules for defining display styles of the display objects and displaying the display objects, comprising a speech synthesizing step for converting text included in a display object to speech, a step of referring to the display rules of the text converted to speech when converting the text to speech in the speech synthesizing step, a step of converting the text of a display object defined by the predetermined display rules to speech with a first voice, and a stop of converting the text of a display object not defined by the predetermined display rules to speech with a second voice.

BRIEF DESCRIPTION OF THE DRAWINGS

These and other objects and features of the present invention will become clearer from the following description of the preferred embodiments given with reference to the attached drawings, wherein:

FIGS. 2A to 2D are views illustrating an example of the outer appearance of a mobile phone, in which FIG. 2A is a front view in an opened state, FIG. 2B is a front view in a closed state, FIG. 2C is a side view in the opened state, and FIG. 2D is a side view in the closed state;

FIG. 4 is a view of an image of a specific style of a display image according to the present embodiment;

FIG. 5 is a view of an example of the notified information, the current font size, and correction values of the style (link) according to the present embodiment;

FIGS. 14A to 14C are views for explaining sort algorithms;

DESCRIPTION OF THE PREFERRED EMBODIMENTS

Below, an embodiment of the present invention will be explained with reference to the attached drawings.

Figure 1:
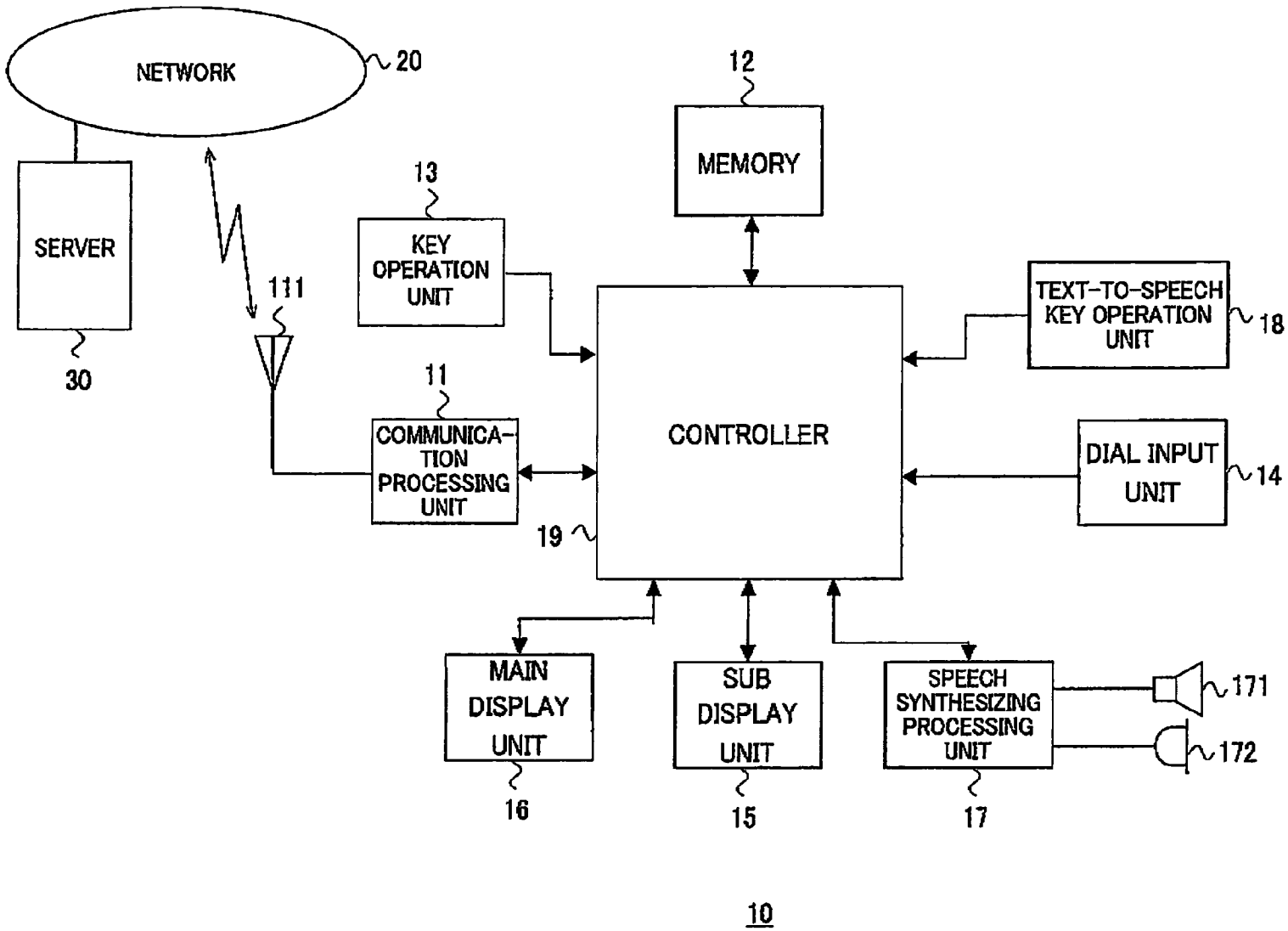
FIG. 1 is a block diagram illustrating an example of the system configuration of a mobile phone.

FIG. 1 is a block diagram showing an example of the system configuration of a text information display device equipped with a speech synthesis function of the present invention as constituted by a mobile phone 10. FIGS. 2A to 2D are views of an example of the outer appearance of the mobile phone 10. The mobile phone 10 is a so-called flip-open type mobile phone having a movement mechanism. FIG. 2A is a front view in an opened state, FIG. 2B is a front view in a closed state, FIG. 2C is a side view in the opened state, and FIG. 2D is a side view in the closed state.

The mobile phone 10 according to the present embodiment is configured so that web information acquired from a server 30 connected to a wireless communication network 20 (acquired information) can be displayed on a display unit. Further, the mobile phone 10 according to the present embodiment has a text-to-speech conversion function in addition to ordinary functions of a phone and is configured so as to treat for example text transferred as a display request from the browser as text information for text-to-speech and so as to be able to give a display equivalent to that of an ordinary browser without modifying the browser.

Further, the mobile phone 10 according to the present embodiment is provided with the following processing functions. The mobile phone 10 extracts text, symbols, images, and other display objects to be displayed and style and other display rules defined by content managed on a server 30 providing the display objects based on the acquired web information, stores the display objects and the display rules in the storage unit linked with each other, and displays the display objects according to the extracted style or other display rules. Note that the display rules include display coordinates (X, Y), display formats (styles) for indicating additional display for example font type such as Gothic and underline, and display sizes.

Further, the mobile phone 10 has a function of converting text extracted from the display objects to speech by a speech synthesizer with reference to the styles and other display rules for defining the display method stored in the storage unit when startup of the text-to-speech conversion function (speech synthesizer) is requested for a text-to-speech operation in the state of display of acquired web information.

Alternatively, the mobile phone 10 has a function of referring to the display rules of the text to be converted to speech and converting the text to speech with a first voice in the case of predetermined display rules and converting the text to speech with a second voice in the case of not predetermined display rules when converting the text included in the text information being displayed on the display unit to speech. Here, the predetermined display rules include a selection position display rule indicating that the object is a display object selected by the operation unit (that is, selected by the cursor). Further, the predetermined display rules include a link destination display rule indicating that a link destination is linked with the display object.

Alternatively, the mobile phone 10 has a function of converting the text included in a display object to speech with a third voice when a display object linked with a link destination is selected or determined by the operation unit. Alternatively, the mobile phone 10 has a function of converting the text included in a determined display object to speech after a link destination is accessed by the communication unit when a display object linked with a link destination is determined by the operation unit. Alternatively, the mobile phone 10 has a function of converting the text included in a display object defined by the selection position display rule to speech when the determined by the operation unit.

Alternatively, the mobile phone 10 has a function of converting text to speech after sorting the display objects stored in the storage unit for display coordinates when startup of the text-to-speech conversion function (speech synthesizer) is requested in the state displaying the acquired web information. Alternatively, the mobile phone 10 has a function of storing correction values for display coordinates for a plurality of display formats and sorting the display objects after correcting them by the correction values in accordance with the display formats of the individual display objects.

Alternatively, the mobile phone 10 has a function of storing correction values for display coordinates for a plurality of display sizes and sorting the display objects after correcting them by the correction values in accordance with the display sizes of the individual display objects. Alternatively, the mobile phone 10 has a function of searching for a display object linked with the display format for display where the cursor is located from among the plurality of display objects stored in the storage unit and converting the text of the retrieved display object to speech when startup of the text-to-speech conversion function (speech synthesizer) is requested in the state displaying the acquired web information.

Below, the configurations and functions of the parts and the text-to-speech conversion control of the mobile phone 10 according to the present embodiment will be explained in sequence.

As shown in FIG. 1, the mobile phone 10 has a communication processing unit 11 including a transmission/reception antenna 111, a memory 12, a key operation unit 13, a dial input unit 14, a sub display unit 15, a main display unit 16, a speech synthesizing processing unit 17 including a speaker 171 and a microphone 172, a text-to-speech key operation unit 18, and a controller (CPU) 19. Further, as shown in FIG. 2A, a main case 100 of the mobile phone 10 is configured by a first housing constituted by a key input side main case 101 and a second housing constituted by a display side main case 102 connected by a not shown movement mechanism to form the opened/closed state.

The communication processing unit 11 performs wireless communication operations via a base station, for example, calling up a phone number and sending or receiving e-mail. The communication processing unit 11 is configured by including the transmission/reception antenna 111. It modulates audio information, e-mail, etc. processed at the controller 19 and transmits the same via a not shown base station and the communication network 20 to the server 30 by the transmission/reception antenna 111 for wireless communication using the radio waves. Further, the communication processing unit 11 demodulates e-mail, audio information, and other various information transmitted wirelessly from the base station and received at the transmission/reception antenna 111 and outputs the same to the controller 19. The communication processing unit 11 outputs web information acquired from the server 30 connected to the wireless communication network 20 (acquired information) to the controller 19. Note that, in the present embodiment, the transmission/reception antenna 111 is built in the key input side main case 101 or the display side main case 102.

The memory (storage unit) 12 is configured by including an EEPROM or other nonvolatile memory and stores a control program for transmitting and receiving speech and mail, an Internet browser, message data, an address book registering names and phone numbers, etc. The memory 12 stores a text-to-speech conversion database including the text necessary for the text-to-speech function explained later. In this database, the text for conversion to speech is systematically arranged in context so as to form sentences. The memory 12 stores a control table and weighting table of the text-to-speech conversion function. The memory 12 stores "standard text", "shortened text", and "explanatory text" for each item of the menu displayed by the display unit. The memory 12 stores the display objects extracted from the web information in the controller 19 and the display rules for defining the display method in the display units 16 and 15, defined by the server providing the display objects linked together. As explained above, the display rules include a selection position display rule indicating that the object is the display object selected by the key operation unit 13, and a link destination rule indicating that a link destination is linked with a display object. Further, the memory 12 stores correction values for display coordinates for the plurality of display formats from the controller 19. Further, the memory 12 stores correction values for display coordinates for the plurality of display sizes from the controller 19.

The key operation unit 13 include an end (hang up)/power key, a start (call) key, tenkeys corresponding to numerals, etc. By the operation by the user of these keys, the user outputs input information to the controller 19. Further, by the operation of the key operation units 13, it is possible to set whether or not to convert to speech the items of the control table of the text-to-speech function stored in the memory 12 (ON/OFF) through the controller 19. By the operation of the key operation units 13, it is possible for the user to select and to determine a display object included in the text information displayed in the display units 16 and 15.

The dial input unit 14 is a dial type of input unit. It is arranged on the side face of the display side main case 102 so as to facilitate operation by the thumb of the user when the user holds the mobile phone 10 in the opened state as shown in FIG. 2C and is configured so that upward and downward, that is, two-way, operation is possible. By operating the dial input unit 14, the user can change the output volume of the audio and the font size displayed on the sub display unit 15 and the main display unit 16. Further, as apparent from FIG. 2C and FIG. 2D, when comparing the dial input unit 14 between the closed state and the opened state, the two-way upward and downward operation directions are physically reversed, but in the present embodiment, the controller 19 controls things so that the user is not made to feel odd by making the operation direction as seen from the user and the action with respect to the operation (for example, the above change of volume and display font size (displayed font size)) always coincide.

The sub display unit 15 has a liquid crystal display (LCD) or other display viewed by the user in the closed state as shown in FIG. 2B. The main display unit 16 has an LCD or other display viewed by the user in the opened state as shown in FIG. 2A. The sub display unit 15 and the main display unit 16 display text of a received e-mail and a variety of text data etc. stored in the memory 12 in the closed state and the opened state under the control of the controller 19. Further, the sub display unit 15 and the main display unit 16 display the acquired web information in the format according to the display rules stored (display coordinates, display format, or/and display size) in the memory 12 under the control of the controller 19 in the closed state and the opened state.

The speech synthesizing processing unit 17 has an audio processing circuit to which a speaker 171 for outputting audio and a microphone 172 for inputting audio are connected for the call function. The speech synthesizing processing unit 17 performs predetermined processing with respect to the audio picked up by the microphone 172 and supplies the same to the controller 19. Further, the speech synthesizing processing unit 17 performs predetermined processing with respect to the audio information supplied by the controller 19 and makes the speaker 171 output it. Further, as shown in FIGS. 2A and 2B, the speaker 171 includes a speech speaker 171*a* and a ringer speaker 171*b*, that is, two audio output units, and outputs audio of the result of the processing of the text-to-speech function.

Further, the speech synthesizing processing unit 17 has a speech synthesizing circuit as a text-to-speech conversion engine which, at the time of text-to-speech conversion, converts text data read out and extracted from the memory 12 to audio data in the controller 19 and synthesizes speech by the audio output unit constituted by the speech speaker 171*a* or the ringer speaker 171*b* to output the same. The speech synthesizing processing unit 17, at the time of text-to-speech conversion, converts the text to speech with a first voice in the case of the predetermined display rules such as the cursor position display, converts the text to speech with a second voice in the case of not the predetermined display rules, and converts the text included in the display object to speech with a third voice when a display object linked with a link destination is selected or determined by the key operation unit 13 under the control of the controller 19.

The text-to-speech key operation unit 18 is configured by a pushbutton 18*a* arranged at the center of the display side main case 102 and an input circuit for the switch input by the pushbutton as shown in FIG. 2B. The mobile phone 10 in the present embodiment has a text-to-speech function and is controlled by the controller 19 so that when the pushbutton 18*a* is depressed (operated), it outputs speech from the ringer speaker 171*b* in the closed state and outputs speech from the speech speaker 171*a* in the opened state.

The controller 19 is mainly configured by a microcomputer which controls the mobile phone 10 as a whole. For example, the controller 19 controls the wireless transmission/reception of various information in the communication processing unit 11, the processing of audio information for the speech synthesizing processing unit 17, the display of information to the main display unit 16, the processing in response to the input information of the key input unit 13, access with respect to the memory 12, etc.

The controller 19 basically executes the text-to-speech function of the displayed text when the user operates the pushbutton 18*a*. At that time, the text-to-speech function used is a type extracting/generating text and converting to speech the text.

The controller 19, as will be explained in detail later, starts up the browser, extracts from the acquired web information the display objects and the display rules defined for each content on the server 30 providing the display objects, stores the display objects and the display rules in the memory 12 linked with each other, and makes the main display unit 16 or the sub display unit 15 display the display objects according to the extracted display rules. When the acquired web information is being displayed on the main display unit 16 or the sub display unit 15 and, in that display state, for example the text-to-speech key operation unit 18 is operated to request startup of the speech synthesizing processing unit 17, the controller 19 makes the speech synthesizing processing unit 17 convert the text extracted from the display objects to speech with reference to the display rules stored in the memory 12.

When converting the text included in the text information being displayed on the display units 16 and 15 to speech, the controller 19 controls the speech synthesizing processing unit 17 so as to convert the text to speech with a first voice in the case of the predetermined display rules (there is the destination of link, cursor position display, etc.) and convert the text to speech with a second voice having a different speech tone from the first voice in the case of not the predetermined display rules with reference to the display rules of the text converted to the speech.

Further, when the display object linked with the link destination (rage) is selected or determined by the key operation unit 13, the controller 19 controls the speech synthesizing processing unit 17 so as to convert the text included in this display object to speech with a third voice having a different speech tone from the first voice.

In this way, the controller 19 of the present embodiment has a function of controlling the speech synthesizing processing unit 17 so as to change the speech tone, speed, intonation, etc. of the text-to-speech operation in accordance with the display style or to change the speech tone, speed, and intonation of the text-to-speech operation at the time of change of the selectable object. The controller 19, when a display object linked with a link destination is determined by the key operation unit 13, controls the speech synthesizing processing unit 17 so as to convert the text included in the determined display object to speech after the link destination is accessed by the communication unit. Further, the controller 19 controls the speech synthesizing processing unit 17 so as to convert the text included in the display object defined by the selection position display rule to speech when determined by the key operation unit 13.

Note that, when the acquired web information is being displayed on the main display unit 16 or the sub display unit 15 and, in that display state, for example the text-to-speech key operation unit 18 is operated to request startup of the speech synthesizing processing unit 17, the controller 19 sorts the display objects stored in the memory 12 based on the display coordinates and then makes the speech synthesizing processing unit 17 convert the text to speech. Further, the controller 19 stores correction values for display coordinates in the memory 12 for the plurality of display formats. The controller 19 sorts the display objects after correcting each display coordinates according to the correction values stored in the memory 12 for the display formats of the individual display objects. Further, the controller 19 stores correction values for the display coordinates in the memory 12 for the plurality of display sizes. The controller 19 sorts the display objects after correcting each display coordinates according to the correction values stored in the memory 12 for the display sizes of the individual display objects.

Further, when the acquired web information is being displayed on the main display unit 16 or the sub display unit 15 and, in that display state, for example the text-to-speech key operation unit 18 is operated to request startup of the speech synthesizing processing unit 17, the controller 19 searches for a display object linked with the display format for display where the cursor is located from a plurality of display objects stored in the memory 12 and makes the speech synthesizing processing unit 17 convert the text of the retrieved display object to speech.

Further, the controller 19 controls the system so as to interrupt the text-to-speech operation when another screen is displayed and to convert text to speech only the first time even when a plurality of display requests are transferred for the same text for example blinking is designated. The controller 19 controls the speech synthesizing processing unit 17 so as to convert text notified divided into several sections into speech all together when converting text to speech by the same speech tone. Further, the controller 19 prevents interruption of a text-to-speech operation by buffering the newly displayed text during the text-to-speech operation. Further, the controller 19 controls the speech synthesizing processing unit 17 so as to interrupt the text-to-speech operation when another screen is displayed, and to interrupt the text-to-speech operation when the cursor moves to a selectable object and convert the selected object to speech. Further, the controller 19 prevents overlapping text-to-speech operations by determining a text-to-speech target range based on coordinate values for text partially exceeding display areas of the display units 16 and 15. Further, the controller 19 is configured so as to notify text again by a re-display request when text is not notified, for example, at the time of displaying based on a cache.

Next, the operation by the above configuration will be explained with reference to FIG. 3 to FIG. 8 focusing on the display of information and text-to-speech conversion operation at the time of startup of the browser.

Figure 3:
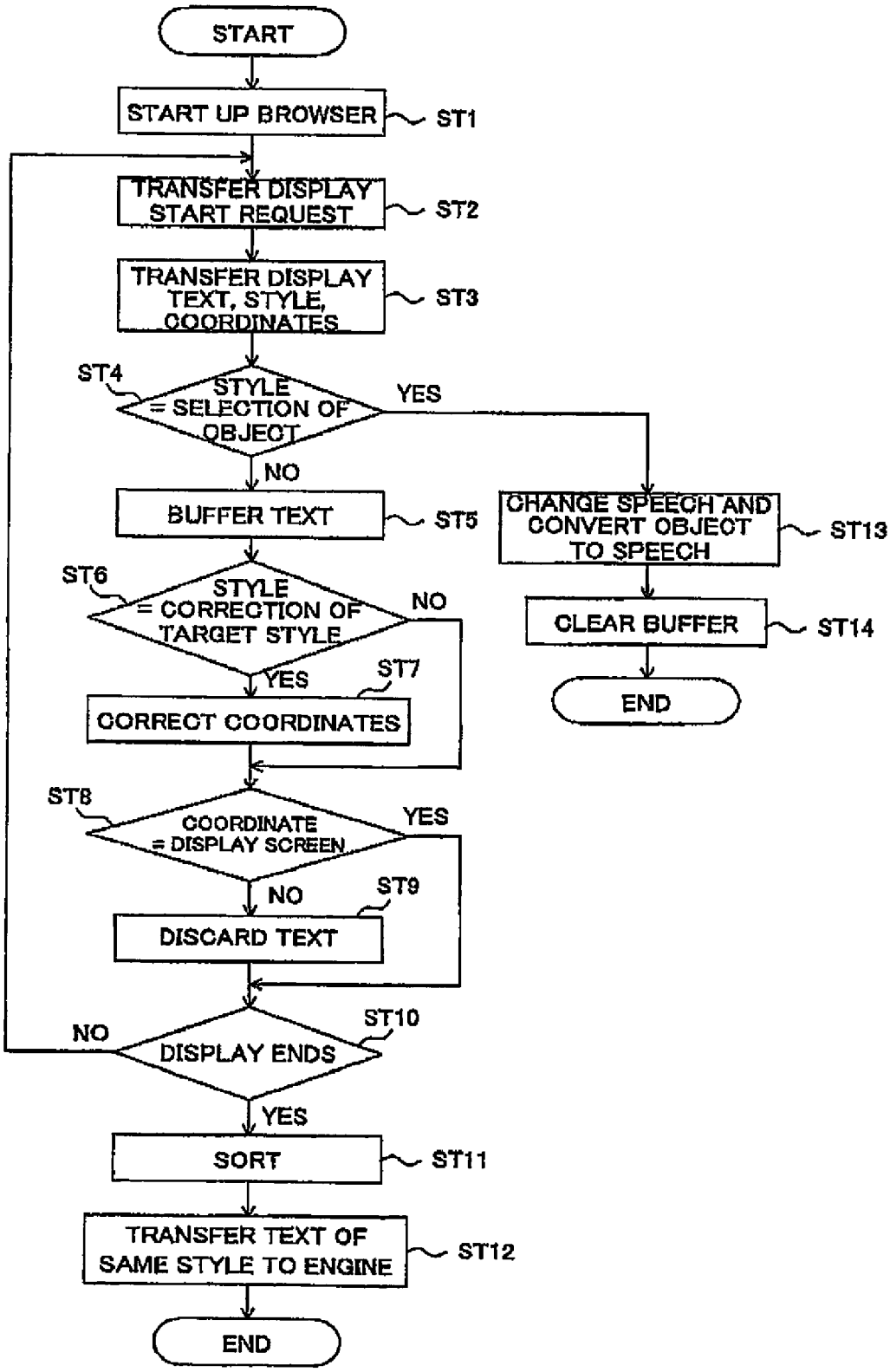
FIG. 3 is a flow chart for explaining the display of information and text-to-speech conversion operation at the time of startup of a browser according to an embodiment of the present invention.
Figure 6:
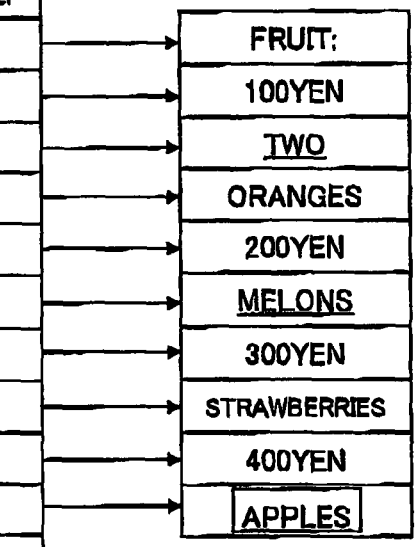
FIG. 6 is a view of an example of storage in a storage region of storage management information and language before sorting of text according to the present embodiment.
Figure 7:
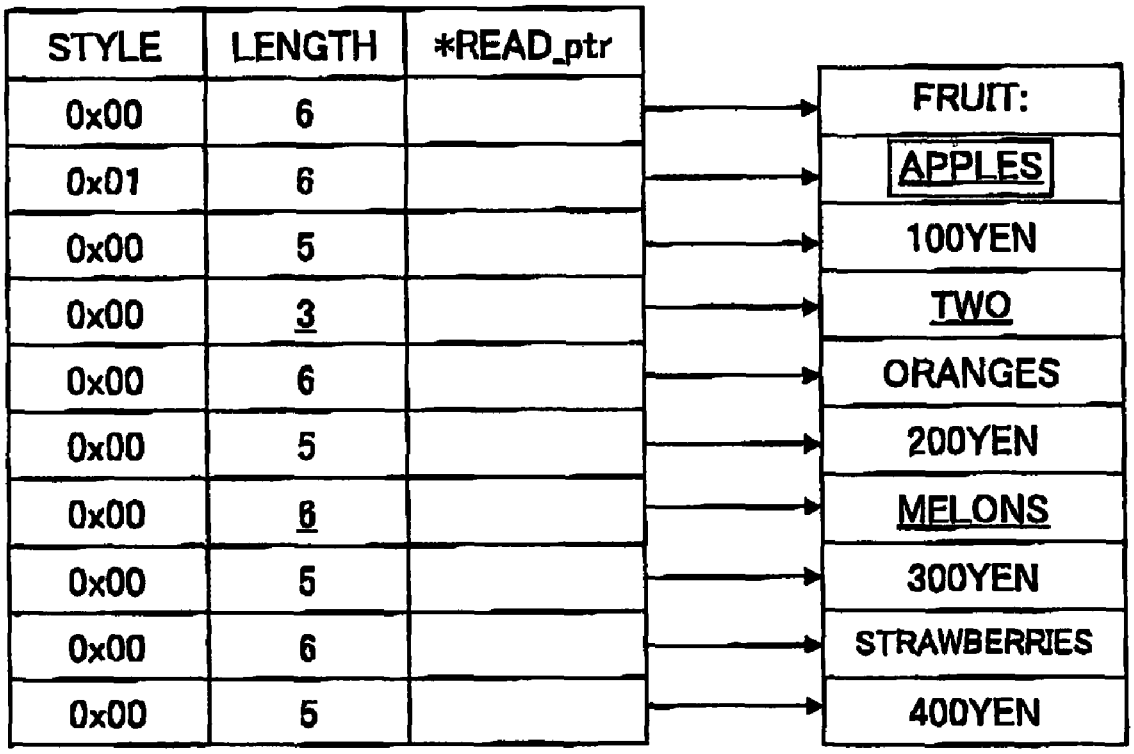
FIG. 7 is a view of an example of storage in a storage region of storage management information and language after sorting of text according to the present embodiment.
Figure 8:
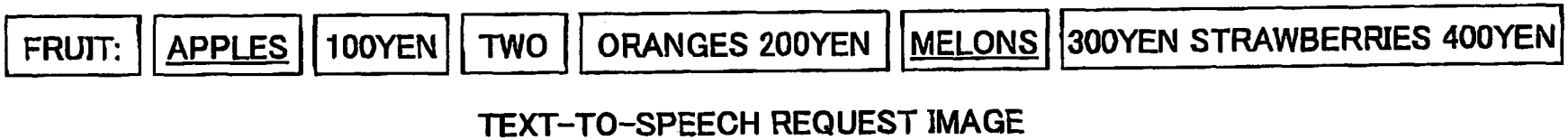
FIG. 8 is a view of an example of the image of a text-to-speech request according to the present embodiment.

FIG. 3 is a flow chart for explaining the display of information and text-to-speech conversion operation of the controller 19 at the time of startup of the browser. FIG. 4 is a view showing an image of the display image in a specific style. FIG. 5 is a view showing an example of the transferred information, the current font size, and the correction values of the style (link). FIG. 6 is a view showing an example of the storage of storage management information and storage regions of text before sorting of the text. FIG. 7 is a view showing an example of the storage of storage management information and storage regions of text after sorting of the text. FIG. 8 is a view showing an example of the image of a text-to-speech request.

When the browser is started up (ST1) and a notification of request for start of a display is issued (ST2), the text to be drawn, the style, and the coordinates are notified (ST3). Next, it is judged whether or not the style information among the acquired information is selection of an object (ST4). When it is judged at step ST4 that it is not selection, the acquired text is for example stored (buffered) in the memory 12 (ST5). Next, it is judged whether or not the acquired style is a style for correction (ST6). When it is judged at step ST6 that the acquired style is a style for correction, the coordinate values are corrected (ST7) and the routine proceeds to the processing of step ST8, while when it is judged that the acquired style is not style for correction, the routine proceeds to the processing of step ST8 without the correction processing of step ST7.

Then, at step ST8, it is judged whether or not the coordinates are beyond the displayed screen. When the coordinate is beyond the displayed screen, the text is discarded (ST9), then the routine proceeds to the processing of step ST10, while when the coordinate is not beyond the displayed screen, the routine proceeds to the processing of step ST10 without the processing of step ST9. At step ST10, it is judged whether or not the display processing ends. When it does not end, the routine proceeds to the processing from step ST2. When is judged at step ST10 that the display processing ends, the text is sorted (ST11) and the text with the same style is transferred (ST12) to the speech synthesizing processing unit 17. When it is judged at step ST4 that the style is a meaning of selecting, the corresponding object is converted to speech (ST13) and the buffer of the text is cleared (ST14).

Note that, in the present embodiment, the text transferred as the display request from the browser is treated as text information for the text-to-speech operation. Then, in each principal step, specifically the following processing is carried out by the controller 19.

The coordinate correction of step ST7 becomes the following processing. For example, as shown in FIG. 4, the coordinate position would be deviated in the display by displaying in the specific style, so the coordinate position is corrected in accordance with the display format (style) and the font size. The coordinate position of a special display object (link) such as "APPLES" in FIG. 4 is corrected too. When the style of the link is notified by the display request, the correction value in accordance with the current font size is determined from the database for correcting the coordinates and the coordinates are corrected with the correction value.

For example, as shown in FIG. 5, when taking as an example a case where the notified information of "APPLES" is that the coordinate value X is 0 and Y is 5, the style is "LINK", the number of letters is "6", the current font size setting is "FONT SIZE STANDARD", and the correction values of the style (LINK) are "Y−3" for the small font size, "Y−5" for the standard font size, and "Y−8" for the large font size, the coordinate position is corrected as follows. The coordinate values are corrected based on the above information. The font size is standard at the style (LINK), so −5 is added to the Y-coordinates of the six letters "APPLES", and the coordinate values are made (X:0, Y:0).

Further, at step ST11, if the text-to-speech operation is carried out in the transferred sequence as the display requests, sometimes the result will not become a right sentence, therefore sorting is carried out by using the coordinate values accompanying the text. Note that, as the coordinate values, the values after the correction processing are used.

FIG. 6 shows an example of the storage of storage management information and the storage regions of text before sorting the text, and FIG. 7 shows an example of the storage after sorting the text. In this example, as shown in FIG. 6, the sequence of the text before the text sorting is "FRUIT:", "100 YEN", "TWO" "ORANGES", "200 YEN", "MELONS", "300 YEN", "STRAWBERRIES", "400 YEN", and "APPLES", but after the text sorting, as shown in FIG. 7, it becomes change as "FRUIT:", "APPLES", "100 YEN", "TWO", "ORANGES", "200 YEN", "MELONS", "300 YEN", "STRAWBERRIES", and "400 YEN"

Further, a different display style is transferred for each display object, therefore a text-to-speech operation in accordance with the display object is carried out. When taking as an example the screen image of FIG. 4, the text of the link is converted to speech by a voice different from the standard (set voice).

Further, the object which the cursor positioned is specified by the display style, and the corresponding text is converted to speech by changing the type of the voice for definition of the position of the cursor. When taking as an example the screen image of FIG. 4, the text of "APPLES" is converted to speech by a voice different from the standard (cursor does not position).

Further, a display request is notified for each line or object, therefore a smooth text-to-speech operation is carried out by buffering and transferring a plurality of display requests all together to the text-to-speech engine (controller and speech synthesizing processing unit). For example, as shown in FIG. 8, even when text is notified for each line, it is possible to convert the same to speech by the same text-to-speech method by ignoring line feeds.

Further, a line scrolling operation during text-to-speech conversion buffers the newly displayed line, and transfers it to the text-to-speech engine at the point of time when the text-to-speech conversion ends.

Further, at the time of page scrolling or jumping to another screen, the text being converted to speech is discarded, and the text-to-speech operation is carried out from the header of the new page.

Further, the text notified during the interval from the display start request to the display end request is set as intended by the text-to-speech conversion. Further, when more than two text are notified at the same coordinates, the first notified text is made valid.

When moving the cursor to a selectable object, the text being converted to speech is interrupted, and the corresponding object (cursor moved object) is converted to speech.

On a screen display, text is sometimes displayed cut off at its top or bottom. In this case, the coverage of the text-to-speech operation is determined by the coordinate values.

When displaying a screen etc. stored as the cache, the display request was not notified, therefore the text is acquired by requesting re-display.

An object not having any text is judged by the style and is converted to speech by specific text (predetermined to the memory 12). For example, for a radio button or other object not having any text, the text-to-speech operation is accomplished by transferring text predetermined in the memory 12 to the text-to-speech engine at the point of time of selection and determination.

Next, an explanation will be given on a specific processing including the function of the browser for the content including the link.

The mobile phone 10 of the present embodiment performs the following processing for the content including the link at its controller 19.

1. When the cursor moves to the link, the text-to-speech operation is carried out with a speech tone different from the set values (for example a woman's voice where the set speech tone is a man's voice): This is judged by the type of letters (link letters) transferred from the browser. In the browser, when recognizing the link, the linked text notified for display is displayed with adding conditions for example the link letters (italic, blue, underline).

2. The text of the link is treated as the title of the next screen: When the cursor moves to the link, the text-to-speech can work the title of the linked screen by acquiring all of the text designated for the link and converting the text of the link to speech after changing from the link to the next (linked) screen. At the time of change by depressing the link the destination of link is determined by notifying the linked destination information (ULR).

3. The link is notified to the user: When depressing the link and changing to the next screen, during the interval up to the start of display of the next screen, the text indicating the change to the next screen separately stored in the memory 12 is converted to speech, and a transition to the linked (next) screen is notified to the user by the text-to-speech operation.

4. All of the text designated in the link is converted to speech: Even when the screen is changed by depressing the link during the text-to-speech operation of the text of the link, the text-to-speech operation of all of the text of the link is enabled.

5. Only the text of the link in the screen is extracted, and the text-to-speech operation of only the link is enabled: The text-to-speech operation is carried out with a set speech quality (for example a man's voice) when the cursor moves to the link, and the text-to-speech operation is carried out with a speech quality different from the set value (for example a woman's voice when the set speech quality is a man's voice) when depressing the link.

6. After depressing the link, when the notification that the screen transition is completed is not notified to the terminal side for a predetermined time, the continuity of communication is informed to the user by converting text indicating continuity of communication separately stored in the memory to speech.

An example of the description of the content including the link (link part) is as follows.

<a href=http://KYOCERA.jp title=KYOCERA>JUMP</a>

Figure 9:
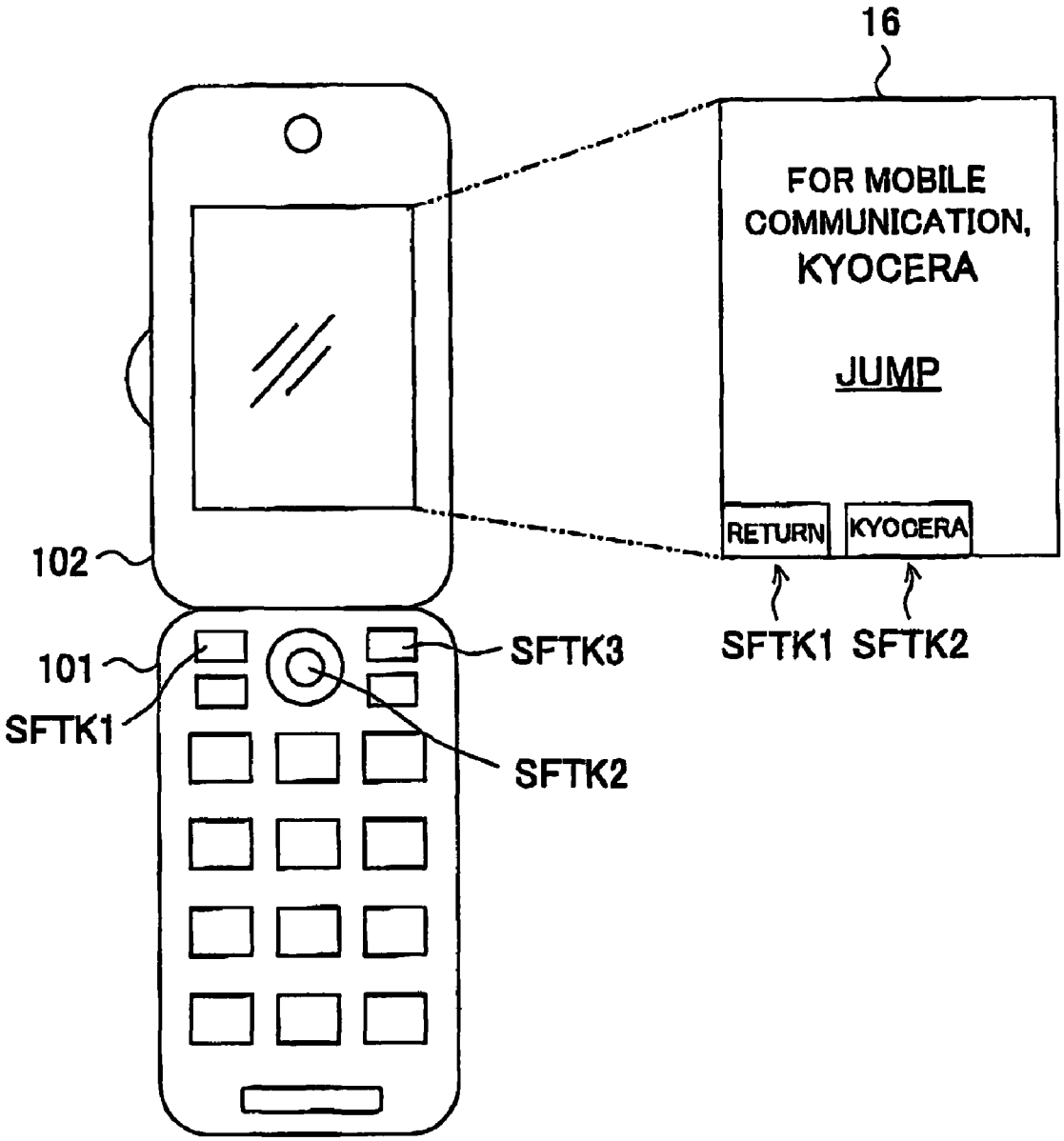
FIG. 9 is a view showing the summary of a case where a web programming language is displayed.

The content of the web programming language is as follows. A summary thereof is shown in FIG. 9.

1. Describe destination of link (http://KYOCERA.jp) in link designation tag (tag a)

2. Display title (KYOCERA) in region corresponding to soft key SFTK2 (display in guide portion).

3. Portion of "JUMP" is displayed in the display unit 16 and this text "JUMP" becomes actual link text.

The browser analyses the above web programming language and notifies the following information on the terminal side.

[Time of Displaying Link Screen]

Write "JUMP" at coordinates (X, Y) with link letter style.

[When Cursor Moves to Link]

Reverse color of coordinates (X, Y).

Write "KYOCERA" in guide region (SFTK2).

[Time of Depression of Link]

Transit since URL is notified.

When the screen including the link is displayed, the font size and font type are determined with respect to the text from the web programming language acquired by the browser and transferred. When the browser acquires "JUMP" of the text of the link portion, "Underline with blue letters and italic letters and display it at coordinates X, Y" and the display setting for the link are carried out.

When the text-to-speech operation key 18 is depressed, the text-to-speech operation is carried out from the head to the end of the screen. The display information of the text used at the screen display is stored in the memory, the coordinates of the text are sorted as mentioned above, and the text-to-speech operation is carried out from the top of the coordinates (top of the screen) in sequence. "JUMP" of the link letters has a designation such as "underline with blue letters and italic letters and display at coordinates X, Y", therefore this designated text is determined as the link, and the type of voice is changed with respect to the text-to-speech engine, and the text-to-speech operation is carried out. When the link is continuously displayed, the text-to-speech operation is carried out by continuing the setting of the type of voice, but when ordinary text is displayed from the link text, the type of voice is returned to an original type.

When the cursor is moved by the key operation of the user and the cursor moves to the link, the letter range of "JUMP" designated with link are identified and displayed with reversed color. The browser determines the setting of the title "KYOCERA" in the link portion when moving the cursor to the link, and the browser displays "KYOCERA" in the key guide region (such as SFTK2) in the display unit. The text-to-speech operation determines the movement of cursor to the link based on a reversal of the letter color, and the text-to-speech operation changes the speech tone from the others. After displaying the entire screen, a command of "reverse the color of specific coordinates" is issued only in the case where the cursor moves to the link, therefore the text during the text-to-speech operation is discarded, the cursor is moved with priority, and the link text is converted to speech.

The mobile phone 10 is provided with soft keys SFTK1 to SFTK3 as shown in FIG. 9. The soft keys are keys which assigned with not only one function but also different frequently at each transited screens, and have guide regions. A guide region on the display unit 16 is provided in the lower display line which is the nearest to a corresponding soft key, and is displayed the name of a present assigned function in response to the screen changed. A plurality of soft keys are frequently provided while including a function of determination like the SFTK2.

When the user operates the direction key, the controller 19 moves the cursor on the screen of the display unit 16 in accordance with the depressed direction. At this time, when the cursor selects "JUMP" as the link text, the reversal of the display color as previously explained is carried out. Namely, for the browser function of the controller 19, the display is updated after adding the display rule such as reversal of color to the display rule acquired as the web information. Also, the text such as the title "KYOCERA" is acquired when the reversal of the color is added to the display rules and displayed particularly in the region corresponding to the determination key SFTK2 of the guide regions.

When the link is depressed, the link destination URL "http://Kyocera.jp" is set the destination of transition for communication with the server 30, and the screen of the destination is displayed based on the new web programming language acquired from the server 30. The time is counted by the timer (in the controller 19) from the start of the communication. When a new screen is not displayed even after the elapse of a predetermined time, even "CONNECTING" is displayed and can be converted to speech. When depressing the link having the title text "KYOCERA", the title "KYOCERA" is stored in the memory. When the display of the new screen is completed, "KYOCERA" is converted to speech preceding the text-to-speech operation of the text of the new screen so as to give the effect of a title.

Figure 10:
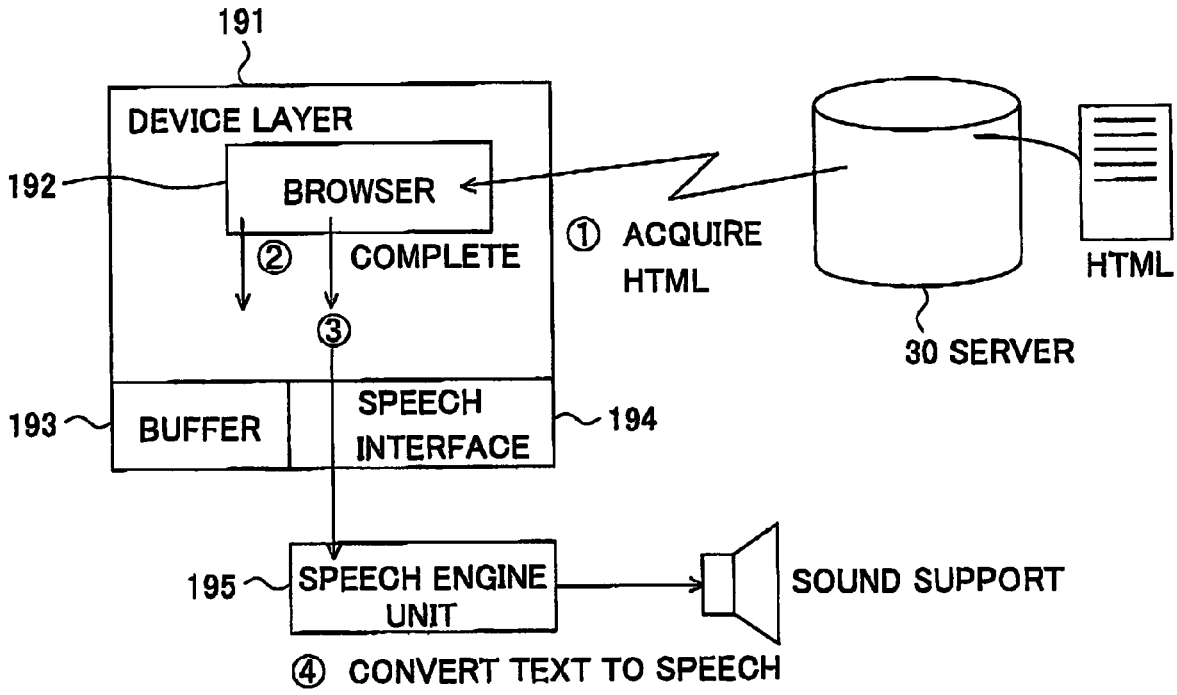
FIG. 10 is a conceptual view showing the summary of processing of a web text-to-speech function according to the present embodiment.

FIG. 10 is a conceptual view showing a summary of the processing of the web text-to-speech function according to the present embodiment. This text-to-speech function is a kind of programs which works to the speech synthesizing processing unit, and performed under the control of the controller 19. A device layer 191 includes a browser 192 and further has a buffer 193, a speech interface 194, and a speech engine unit 195. The speech engine unit 195 is configured including the function of the speech synthesizing processing unit 17.

The processing of the web text-to-speech function is carried out as follows.

1. Acquire HTML (text-to-speech target) from the server 30.

2. The browser 192 requests the display of text in the HTML to the device layer 191. The device layer 191 stores this in the buffer 193.

3. The completion of display is notified from the browser 192 to the device layer 191. At this time, the text-to-speech operation of the text store in the speech interface 194 is requested.

4. The text is converted to speech at the speech engine unit 195.

Figures 11A, 11B:
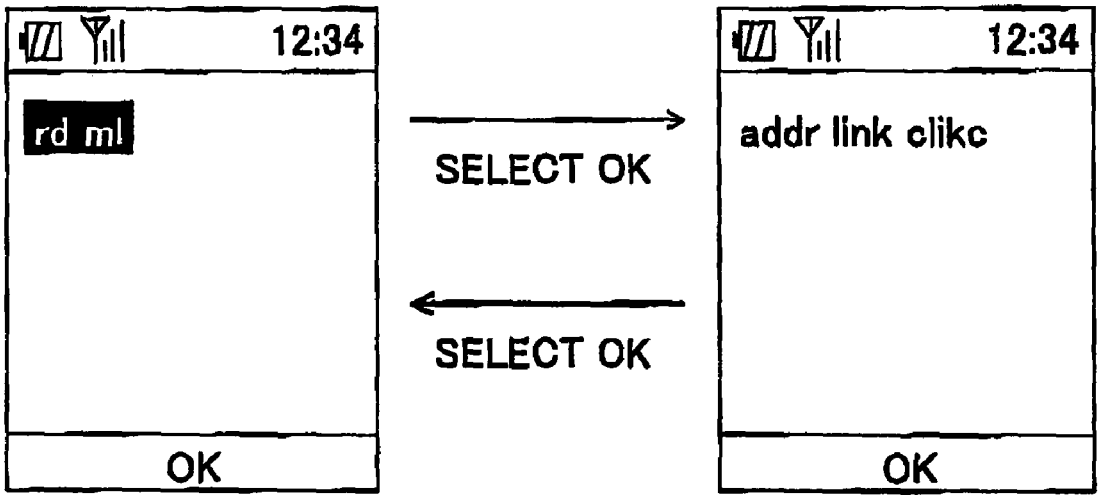
FIGS. 11A and 11B are views for explaining that the text-to-speech operation is possible by reversing the speech even for <addr> tag.

In the present embodiment, the text-to-speech operation is also possible by reversing the speech by <addr> tag indicating that the address information as shown in FIGS. 11A and 11B are linked. An example of the description in this case is as follows.

<addr title="addr link click">html</addr>

In this way, there are many examples of display rules. Naturally, when there is text linked with a phone number or text linked with a mail address other than this, rules different from ordinary rules are added to the display rules.

The operation from the reception of the display text by the text notification command from the browser 192 to the transfer as the text-to-speech text to the task of the speech engine unit 195 is carried out in the following sequence.

The sequence is:

1. Notify the completion of update of screen and

2. Sort by X, Y coordinates.

Below, each procedure will be explained.

1. Notify the Completion of Update of Screen

The browser 192 requests display many times by text notification commands. Therefore, it is necessary to detect the notification indicating the end of the display of screen from the browser. This is realized by detecting a notification function indicating the change of a WML format issued from the browser 192 and detecting a notification function indicating the and of the update of screen after that.

2. Sort by X, Y Coordinates

Figure 12:
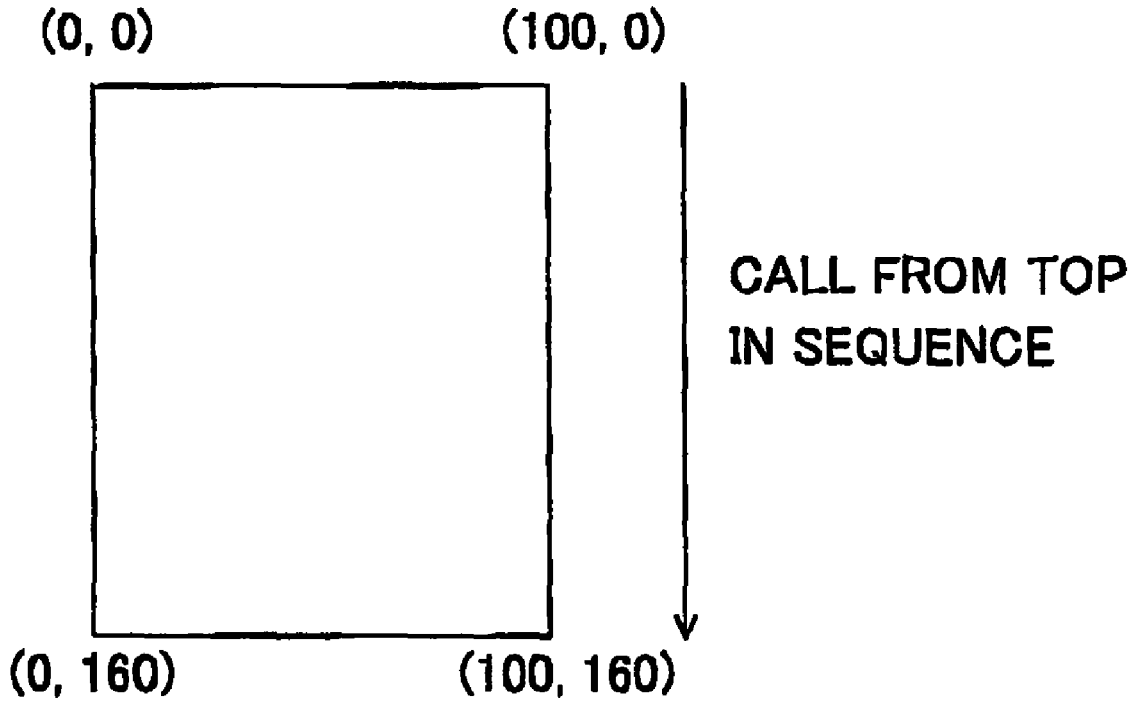
FIG. 12 is a view for explaining sorting of X, Y coordinates.
Figures 13A, 13B:
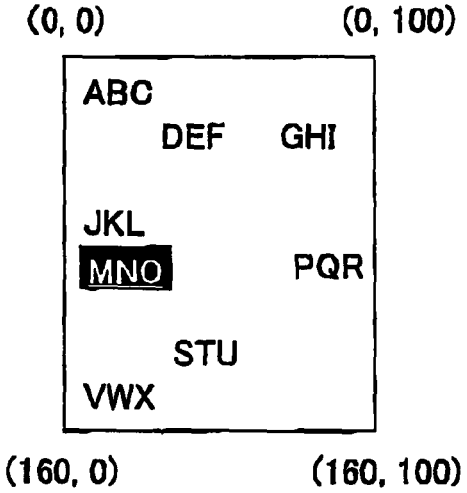
FIGS. 13A and 13B are views for explaining a display request in a case where a cursor selects a link of text.

The text to be displayed is transferred to the device layer from the browser by a text notification command. As shown in FIG. 12, the text to be displayed from the top in sequence is transferred using the top left except a pictograph region of the display unit 16 as the start point (0, 0). However, when text designating a link destination is included by the text, and the cursor selects the link, the request of display is carried out last only for the text by the text notification command. The state is shown in FIGS. 13A and 13B.

When converting the text to speech in the sequence of the display requests of this browser 192, it becomes "ABCDEFGHIJKLPQRSTUVWMNO". That is, the sorting of the text becomes necessary in order to convert this to speech in the correct sequence. This is carried out based on the (X, Y) coordinates of the text notification command of the display request. FIGS. 14A to 14C show sort algorithms. In this example, the sorting is carried out upward by the Y-coordinates. Note that when the values of Y are the same, the values of the X-coordinates are compared in the upward sequence. When the values of X are also the same, the value issuing the display request first is given the highest priority. As a result of this sorting, the text-to-speech text becomes "ABCDEFGHIJKLMNOPQRSTUVWX".

Next, judgment of full screen display/scroll display in the web text-to-speech operation will be explained.

<Full Screen Display Judgment>

Figure 15:
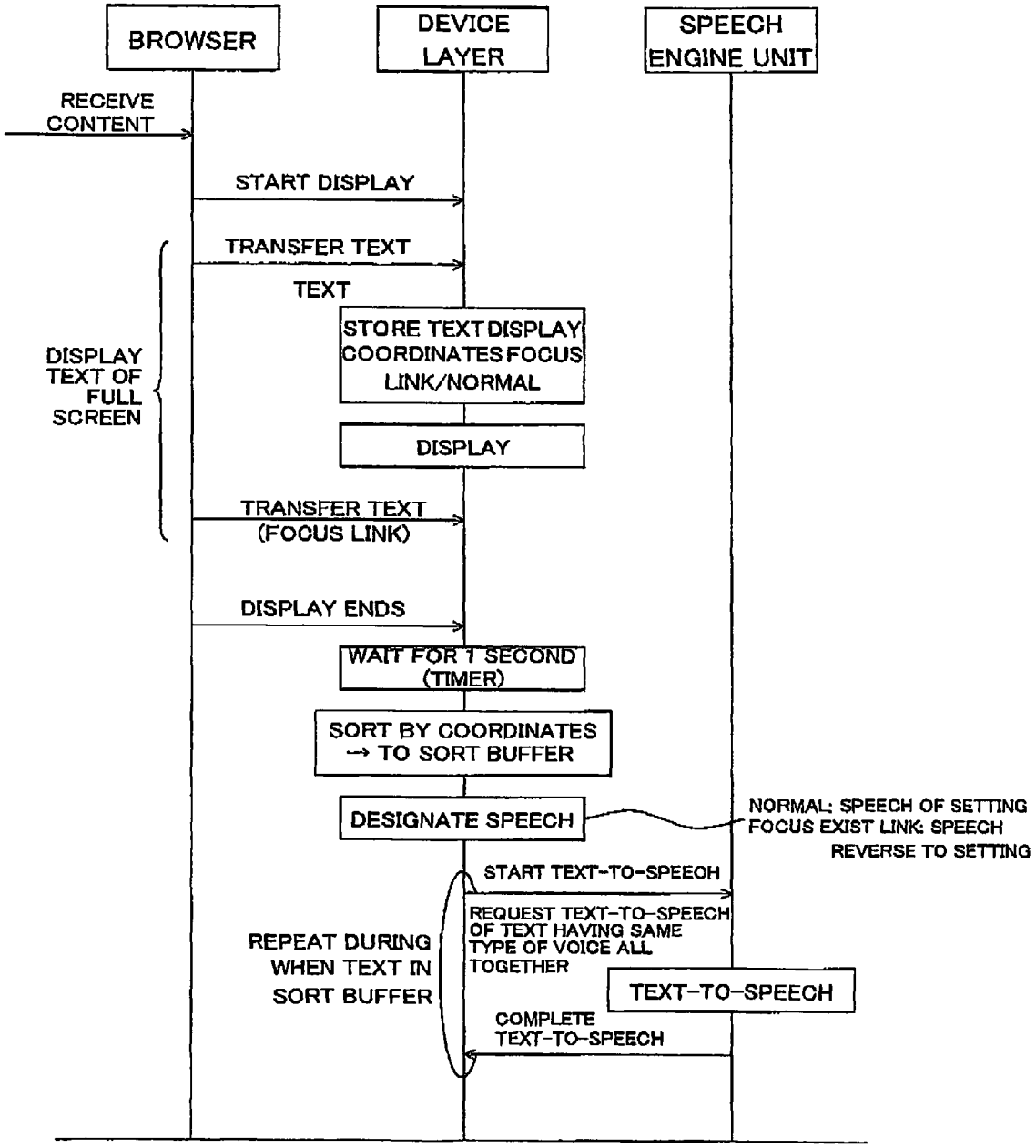
FIG. 15 is a view showing a basic sequence when converting an entire page to speech.

FIG. 15 is a view showing a basic sequence when converting an entire page to speech.

The interval from the display immediately after the display start command is called up to the display before the display end command of the completion of display is called up is deemed the full screen display. In this case, the text, display coordinates, focus link/normal are stored in the buffer 193 for display. When the display completion is notified to the device layer 191, sorting is carried out by coordinates after waiting for a predetermined time, for example, 1 second, and the results are stored in the sort buffer. Then, the device layer 191 designates the voice (speech tone). The set voice is used in the normal case, while a voice different (opposite, the other) to the setting is used in the case of a focus link. For example, a woman's voice is used when the setting is a man's voice. The device layer 191 requests the text-to-speech operation of text having the same type of voice all together to the speech interface 194. The device layer 191 repeats this request processing during the period where there is text in the sort buffer until a notification of the completion of the text-to-speech operation is received.

<Scroll Display Judgment>

Figure 16:
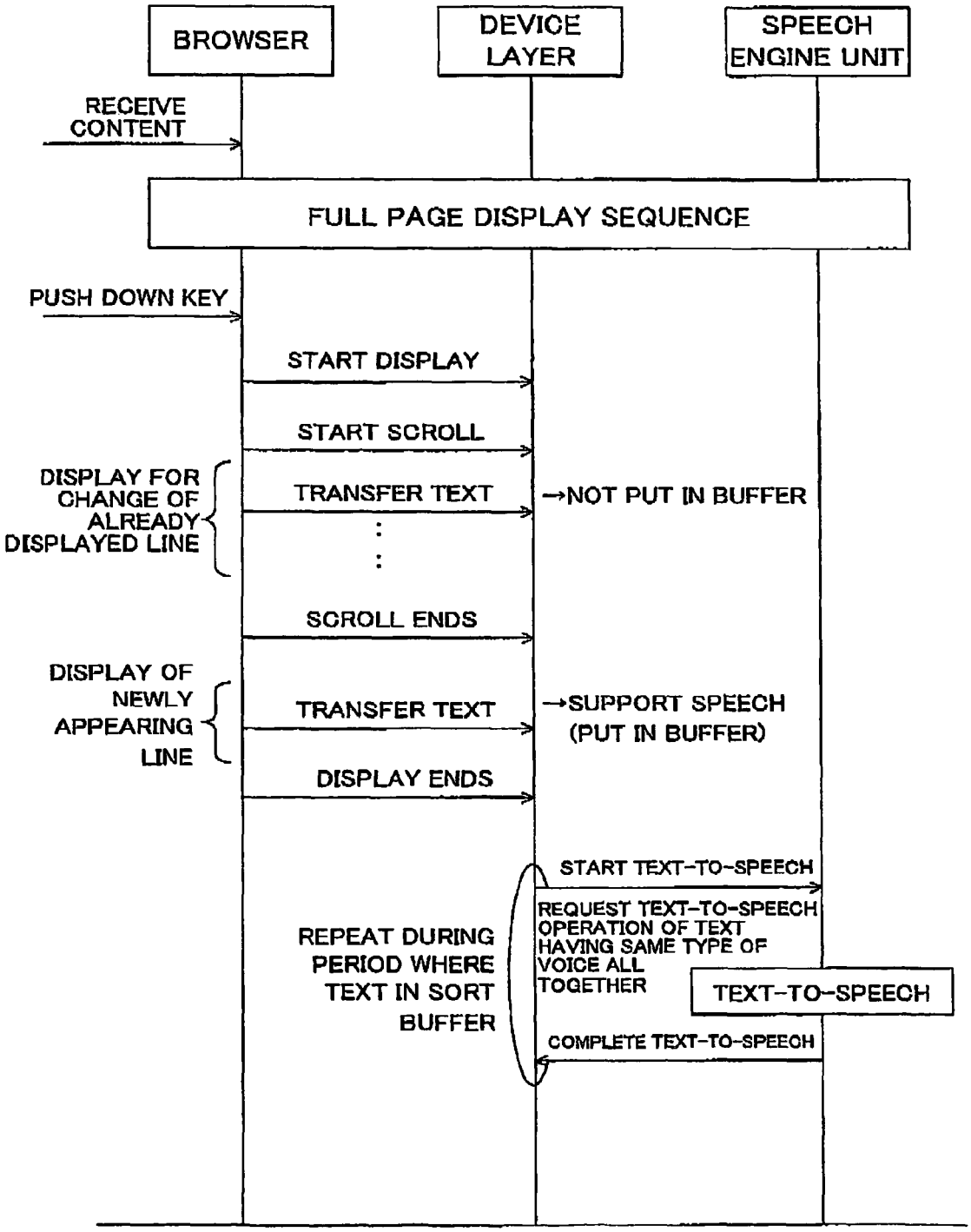
FIG. 16 is a view showing a text-to-speech sequence at the time of a scrolling in a line direction.

FIG. 16 is a view showing a text-to-speech sequence at the time of the scrolling in the line direction.

An interval from the display after the scroll start command is called up to the display before the display end command is called up is deemed as the scroll display. Further, when the scroll start command is called up with a value of plus (+), it is judged that the scrolling is in the downward direction, while when called up with a value of minus (−), it is judged that the scrolling is in the upward direction. In the case of display for a change of an already displayed line, the text is not stored in the buffer, while in the case of display of a newly appearing line, the text is stored in the buffer for the text-to-speech operation. Then, the device layer 191 requests the text-to-speech operation of different text of the same type of voice all together to the speech interface 194. The device layer 191 repeats this request processing during the period where there is text in the sort buffer until a notification of the completion of the text-to-speech operation is received.

According to the present embodiment, provision is made of the controller 19 for controlling the speech synthesizing processing unit 17 when converting the text included in the text information being displayed on the main display unit 16 to speech, so as to convert the text to speech with a first voice in the case of predetermined display rules (presence of link destination, cursor position display, etc.) and convert the text to speech with a second voice having a speech quality different from that of the first voice in the case of not the predetermined display rules with reference to the display rules of the text to be converted to the speech and controlling the speech synthesizing processing unit 17 so as to convert the text included in the display object to speech with a third voice when a display object linked with a link destination is selected or determined by the key operation unit 13, therefore it is possible to clearly display a linked operation by speech, and it is possible to easily recognize a change from a link.

Further, the controller 19 is configured so as to correct coordinate values in accordance with the style of the notified text, perform the text-to-speech operation after sorting not in the sequence of transfer, but by the coordinates, change the speech quality, speed, intonation, etc. of the text-to-speech operation in accordance with the display style, change the speech quality, speed, and intonation of the text-to-speech operation at the time of change of the selectable object, and convert text to speech only once even when the sane text is transferred by for example blinking. Therefore, the following effects can be obtained.

Smooth text-to-speech conversion can be realized. Because display requests are used for the text-to-speech operation, the operation can be realized without modifying the browser. As a result, display equivalent to that by an ordinary browser becomes possible. When converting text to speech by the same speech quality, by converting text transferred divided into several sections all together, interruption of the text-to-speech operation can be prevented, and the probability of correctly reading a phrase rises. Further, during the text-to-speech conversion, the newly displayed text is buffered, therefore the buffered text can be converted to speech after the end of a text-to-speech operation. This enables interruption of the text-to-speech operation to be prevented. Further, the text-to-speech operation can be interrupted when another screen is displayed and therefore the screen and the text-to-speech conversion can be matched. Further, when the cursor moves to another selectable object, the text-to-speech operation can be interrupted and the corresponding object converted from text to speech, so text-to-speech operation is possible without offset in the selected timing. Further, for text partially projecting from the display area, the text-to-speech target range can be determined by the coordinate values, so double conversion to speech can be prevented. At the time of cache display or otherwise when the text is not transferred, the text can be transferred again by requesting redisplay. Since the same screen is displayed even if acquiring the text and displaying it again, flickering does not occur. Further, by judging an object not having any text by the style, it is possible to give it specific text and convert that text to speech.

Note that the text-to-speech conversion processing explained above is stored in a storage medium which can be read by a terminal (computer), a semiconductor storage device (memory), an optical disk, a hard disk, etc. as a text-to-speech program and is read out and executed by the terminal.

And needless to say, the browser is a kind of operation that the controller 19 works based on the programs in the memory 12. The browser's work is like that making the communication processing unit 11 to communicate with the server 30, and the main or sub display unit 16, 15 to display acquisition data via the network 20, and operated by the input unit 14.

While the invention has been described with reference to specific embodiments chosen for purpose of illustration, it should be apparent that numerous modifications could be made thereto by those skilled in the art without departing from the basic concept and scope of the invention.

I claim:

1. A text information display apparatus, comprising:

a storage unit for storing text information including display objects with text and display rules for defining display styles of the display objects, wherein said display rules do not comprise audio styles of the display objects, a display unit for displaying the display object stored in the storage unit, a speech synthesizer for converting text to speech, a controller for, if the speech synthesizer is requested to convert text of the display objects displayed on the display unit to speech, referring to the corresponding display rules of text to be converted to speech and controlling the speech synthesizer based on the corresponding display rules so as to convert with a first voice in a case that the referred display rules comprise a predetermined display rule and to convert with a second voice in a case that the referred display rules do not comprise the predetermined display rule, wherein the display rules include a link destination display rule indicating that a link destination is linked with the display object, a communication unit for connecting to a network and acquiring the text information, an operation unit for determining at least one display object displayed on the display unit, and the controller controls the speech synthesizer so as to convert the text included in the determined display object to speech after the link destination is accessed by the communication unit when the display object linked with the link destination is determined by the operation unit.

2. The text information display apparatus as set forth in claim 1, wherein the display rules include a selection position display rule indicating that an object is the display object selected by the operation unit.

3. The text information display apparatus as set forth in claim 1, wherein the controller controls the speech synthesizer so as to convert the text included in the determined display object to speech with a third voice when the display object linked with the link destination is determined by the operation unit.

4. A text-to-speech method in a text information display device for storing text information including display objects with text and display rules for defining display styles of the display objects and for displaying the display objects, wherein said display rules do not comprise audio styles of the display objects, comprising:

a speech synthesizing step for converting text included in the display object to speech, a referring step for referring to the display rules of the text converted to speech when converting the text to speech in the speech synthesizing step;

a step of converting the text of the display object defined by the predetermined display rules to speech with a first voice, a step of converting the text of the display object not defined by the predetermined display rules to speech with a second voice, wherein the predetermined display rules include a link destination display rule indicating that a link destination is linked with the display object; and a step of converting the text included in the determined display object to speech after the link destination is accessed by a communication unit when the display object linked with the link destination is determined.

5. The text-to-speech method as set forth in claim 4, wherein the predetermined display rules include a selection position display rule indicating that an object is a selected display object.

6. The text-to-speech method as set forth in claim 4, wherein the step of converting the text included in the display object to speech uses a third voice when the display object linked with the link destination is determined.

7. The text-to-speech method as set forth in claim 4, wherein the display rules include a selection position display rule for indicating that an object is a selected display object, and the method further comprises a step of converting the text included in the display object defined by the selection position display rule to speech when at least one display object included in the text information to be displayed is determined.

8. A non-transitory computer readable medium comprising a text-to-speech program able to be run by a computer for realizing text-to-speech conversion in a text information display device storing text information including display objects and display rules for defining display styles of the display objects and displaying the display objects, wherein said display rules do not comprise audio styles of the display objects, comprising:

a speech synthesizing step for converting text included in the display object to speech, a step of referring to the display rules of the text converted to speech when converting the text to speech in the speech synthesizing step, a step of converting the text of the display object defined by the predetermined display rules to speech with a first voice, a step of converting the text of the display object not defined by the predetermined display rules to speech with a second voice, wherein the predetermined display rules include a link destination display rule indicating that a link destination is linked with the display object; and a step of converting the text included in the determined display object to speech after the link destination is accessed by a communication unit when the display object linked with the link destination is determined.

* * * * *